US007458319B2

(12) United States Patent
Stöhr

(10) Patent No.: US 7,458,319 B2
(45) Date of Patent: Dec. 2, 2008

(54) SCREEN PRINTING MACHINE AND SCREEN CYLINDER

(75) Inventor: Manfred Georg Stöhr, Güntersleben (DE)

(73) Assignee: KBA-GIORI S.A., Lausanne (CH)

( * ) Notice: Subject to any disclaimer, the term of this patent is extended or adjusted under 35 U.S.C. 154(b) by 0 days.

(21) Appl. No.: 11/820,717

(22) Filed: Jun. 20, 2007

(65) Prior Publication Data

US 2007/0261575 A1 Nov. 15, 2007

Related U.S. Application Data

(63) Continuation of application No. 10/513,162, filed on Nov. 1, 2004, now Pat. No. 7,287,467.

(51) Int. Cl.
*B41L 13/00* (2006.01)

(52) U.S. Cl. ..... 101/127.1; 101/116

(58) Field of Classification Search ..... 101/127.1, 101/116

See application file for complete search history.

(56) References Cited

U.S. PATENT DOCUMENTS

| | | | | |
|---|---|---|---|---|
| 3,556,004 | A | 1/1971 | Mitter et al. | |
| 3,599,565 | A | 8/1971 | Feler et al. | |
| 3,960,076 | A | 6/1976 | Wick | |
| 3,971,313 | A | 7/1976 | Voegelin | |
| 4,026,208 | A | 5/1977 | Horne et al. | |
| 4,056,055 | A | 11/1977 | Zimmer | |
| 4,909,143 | A * | 3/1990 | Van den Berg et al. | 101/118 |
| 5,301,000 | A * | 4/1994 | Heigl | 399/122 |
| 6,745,686 | B1 | 6/2004 | Frick et al. | |
| 2003/0147680 | A1 * | 8/2003 | Kawamura et al. | 399/329 |

FOREIGN PATENT DOCUMENTS

| | | |
|---|---|---|
| AT | 296928 B | 3/1972 |
| AT | 303659 B | 12/1972 |
| AT | 327851 B | 2/1976 |
| AT | 382821 B | 4/1987 |
| DE | 178527 A | 2/1972 |
| DE | 2939869 A | 4/1981 |
| EP | 0533053 A | 3/1993 |
| EP | 0863000 A | 9/1998 |

* cited by examiner

*Primary Examiner*—Anthony H. Nguyen
(74) *Attorney, Agent, or Firm*—Clifford W. Browning; Krieg DeVault LLP

(57) ABSTRACT

The invention relates to a screening machine comprising a frame and two bearing arrangements which are arranged thereon for the rotational positioning of a screening cylinder, whereby the bearing arrangements comprise rings which are rotationally driven around a common axis and which support catches on the sides opposite to each other. In order to enable the head piece of the screening cylinder to be mounted on the ring, said catches can be positioned on one half of the periphery thereof.

18 Claims, 7 Drawing Sheets

SCREEN PRINTING MACHINE AND SCREEN CYLINDER

This is a continuation of prior application Ser. No. 10/573,162, filed Nov. 1, 2004, now U.S. Pat. No. 7,287,467, which claimed priority benefits under 35 U.S.C. §119 (a)-(d) or (f), or 365 (b) of prior foreign German Application No. 10219845.4 filed on May 3, 2002.

The invention relates to a screen printing machine and screen cylinder in accordance with the preamble of claim 1, 2, 7 or 12.

EP 1 090 752 A1 describes a screen cylinder for a screen printing machine. This screen cylinder is essentially composed of two supporting rings, which form the axial ends of the screen cylinder, and a screen in the form of a thin fabric cover, the edges of which are fastened to the supporting rings. The supporting rings can be driven to rotate on frames of the screen printing machine.

As can be seen from JP 031 21 848 A, for example, the screen cylinder must be installed and removed from time to time during a change of job or when replacing a worn screen. Usually, the supporting rings of the screen cylinder each have a gear rim or a similar coupling device which meshes with a drive head of a gear mechanism in order to drive the rotary movement of the screen cylinder. This meshing must in each case be stopped when the screen cylinder is removed and recommenced when it is installed again. This means that the installation and removal operations are time-consuming. Moreover, the presence of the gear rim increases the weight of the supporting rings and makes handling more difficult during the installation and removal operations.

AT 382 821 B discloses a round screen which is fastened in a mount by means of a bayonet catch.

It is an object of the invention to provide a screen printing machine and a screen cylinder.

This object is achieved according to the invention by the features of claim 1, 2, 7 or 12.

In the screen printing machine, the supporting ring of a conventional screen cylinder is as it were divided in two, on the one hand into a ring which can be driven in rotation and regarded as part of the bearing arrangement of the screen cylinder, which ring does not have to be removed when exchanging the screen cylinder, and on the other hand a head piece of the screen cylinder which can be releasably mounted on claws of said ring and merely has the function of stretching the screen to give the desired cylinder shape. In order to simplify the mounting of the screen cylinder or of its head piece on the rings, it is provided that the claws of each ring can in each case be placed on only half of the circumference thereof. In this way, a head piece can be installed in or removed from its position in which it is held on the ring, in a movement transverse to the axis of the screen cylinder, over the claw-free half of the circumference of the ring.

According to one preferred embodiment, the rings of the two bearing arrangements each bear at least two claws, at least one of which can be rotated about the axis of the screen cylinder from a position in which it lies together with the at least one other claw on half the circumference of the ring into a position in which not all the claws lie on half the circumference of the ring. Detachment of the head piece from the ring is reliably avoided by fixing the rotatable claw in this position.

In an embodiment with two claws, the position in which the rotatable claw is fixed preferably lies diametrically opposite the other claw with respect to the axis of the screen cylinder. In more general terms, it can be said that the center of gravity of the rotatable first claw lies diametrically opposite that of the at least one other, non-rotatable claw.

According to a second embodiment, the ring has only a single claw or a number of claws, although these cannot move relative to one another. In order in this case to securely hold the head piece on the ring, it is necessary for two lateral edges of the claws to enclose an angle of 180° with respect to the axis. In this embodiment, secure holding of the head piece on the ring can be achieved in particular in that the claw or claws each have an inner surface intended for contact with the head piece, said inner surface lying on a cone centered around the axis of the screen cylinder, wherein the vertex of the cone lies on that side of the bearing arrangement having the claws which faces away from the respective other bearing arrangement.

Spring elements may be provided on the claws of the ring of at least one bearing arrangement, which spring elements exert on a head piece mounted on the claws an axial force oriented away from the respective other bearing arrangement. These spring elements may have different functions.

On the one hand, the screen printing machine may be designed such that, during operation thereof, the spring elements keep open a gap between the head piece and the inner surfaces of the retaining claws. The axial tension of the screen is in such a case defined by the force of the spring elements and can be adjusted by adjusting the axial position of the rings within certain limits. The advantage of this design lies in the fact that when an axial impact drives the head pieces apart for a short time or a force acting radially on the screen increases the tension thereof in the axial direction, the springs yield and can thus limit the screen tension and prevent the screen from tearing.

However, it may also be provided that, during operation of the screen printing machine, the inner surfaces of the claws make contact with the flange, for instance in order to clamp it and hold on to it. In such a case, the spring elements may be used to release the head pieces of the screen cylinder from the retaining claws during removal of the screen cylinder. This may be necessary in particular if the head piece gets stuck on the claws on account of dye residues that have accumulated during operation.

A head piece for a screen cylinder has a cylindrical support section for attaching a screen and a flange which is connected to the support section and projects in the radial direction, it being possible for the claws to grip onto said flange.

In order to be able to transmit a rotary drive force from the ring to the head piece, the flange of said head piece preferably has a non-round radial cross section, in particular in the form of two sections which follow one another in the circumferential direction and have different radial widths. The size of these sections in the circumferential direction should preferably be such that radially oriented surfaces which separate the sections of different radial widths of the flange from one another bear against in each case a lateral edge of a claw.

Examples of embodiment of the invention are shown in the drawings and will be described in more detail below.

Figure 2:
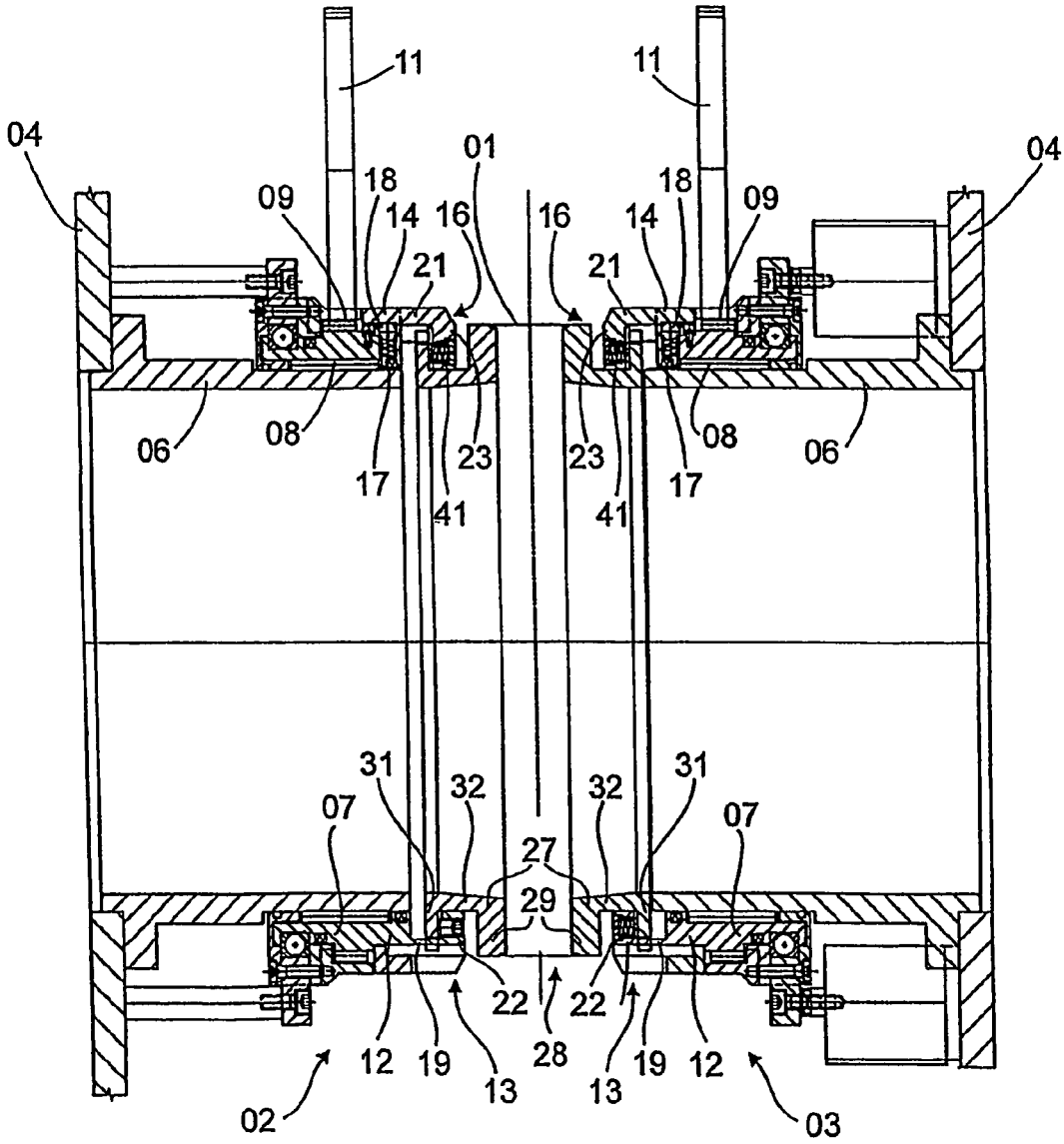
FIG. 2 shows an axial section through the bearing arrangements of FIG. 1.
Figure 4:
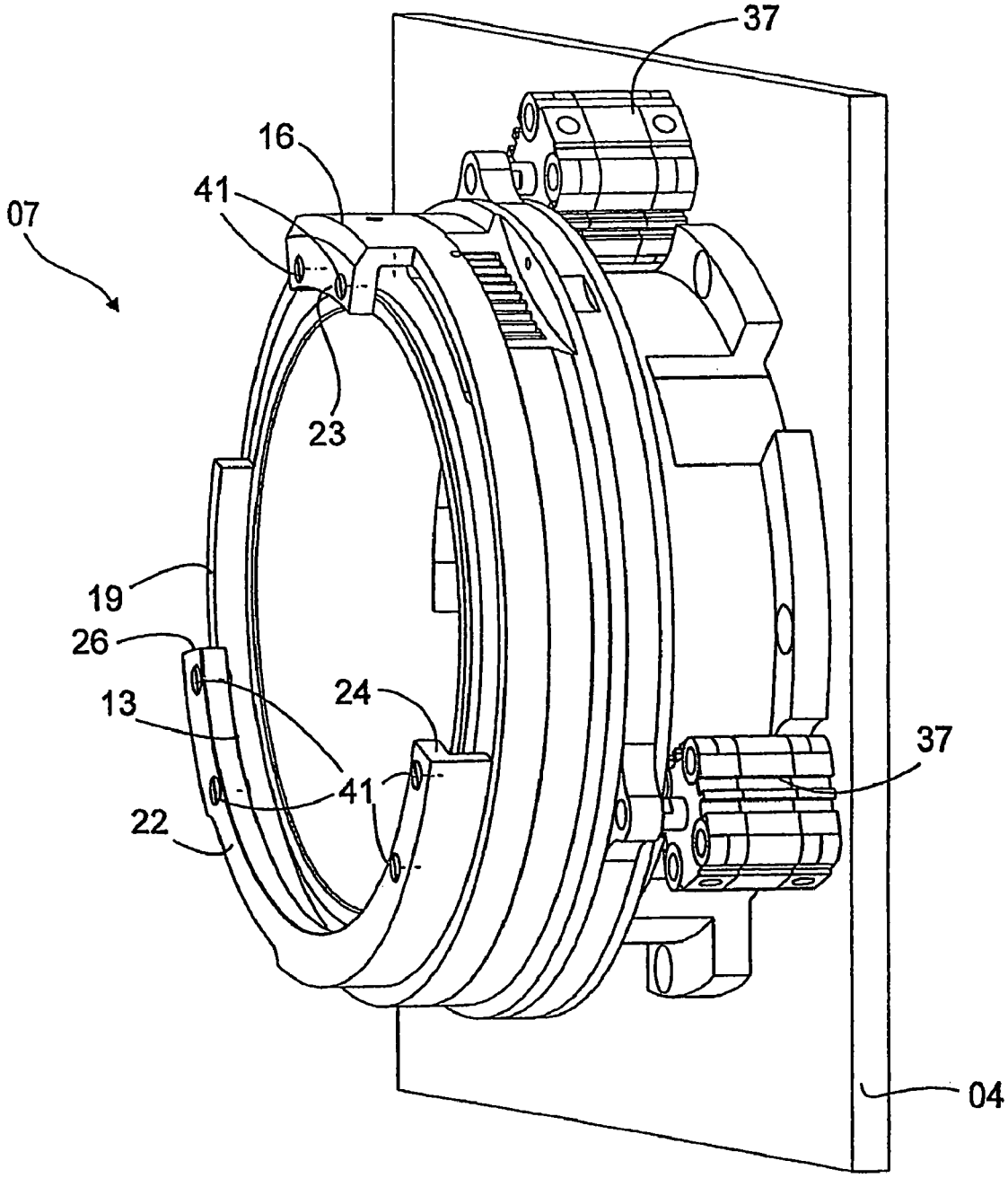
Figure 5:
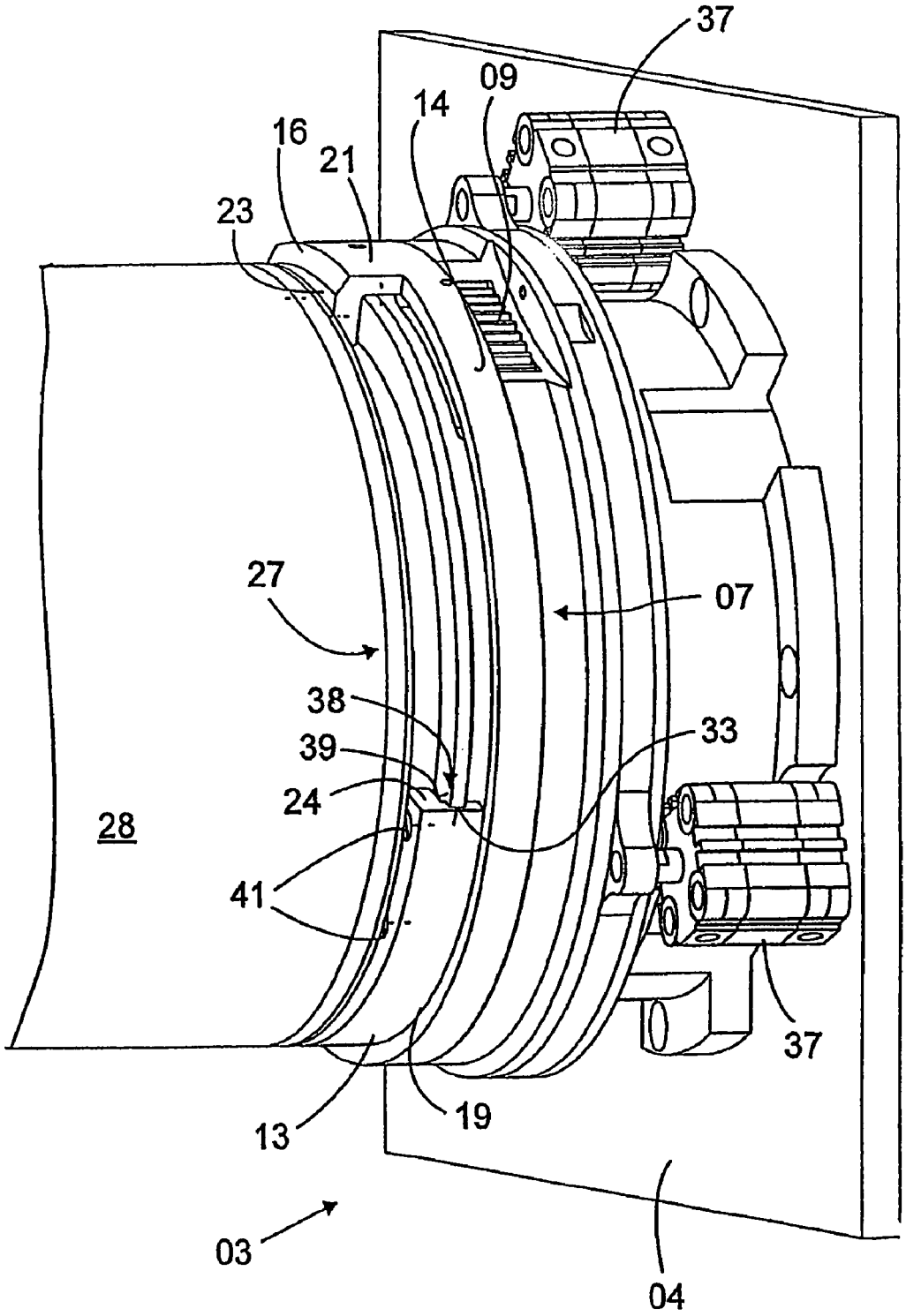
Figure 6:
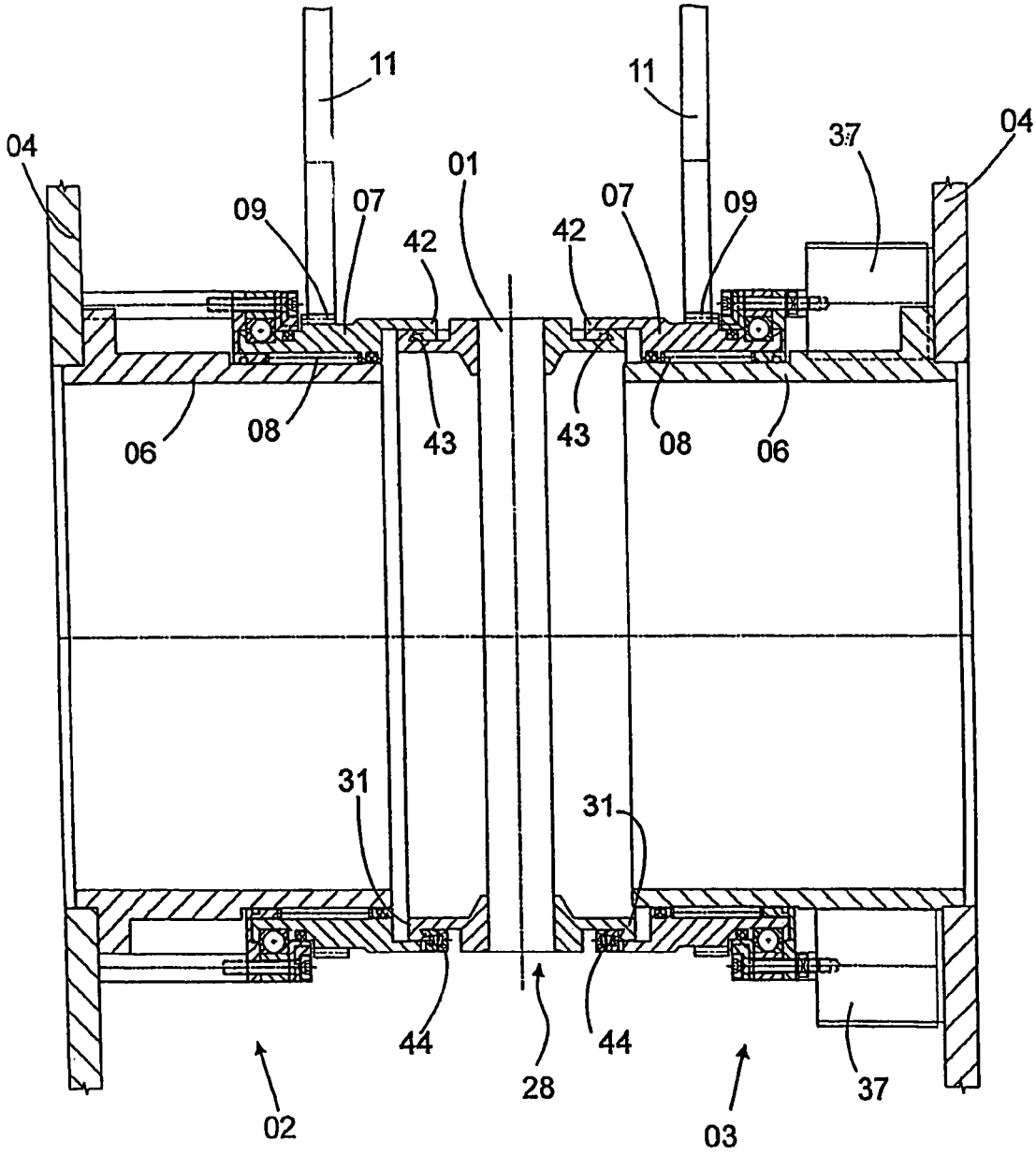
Figure 7:
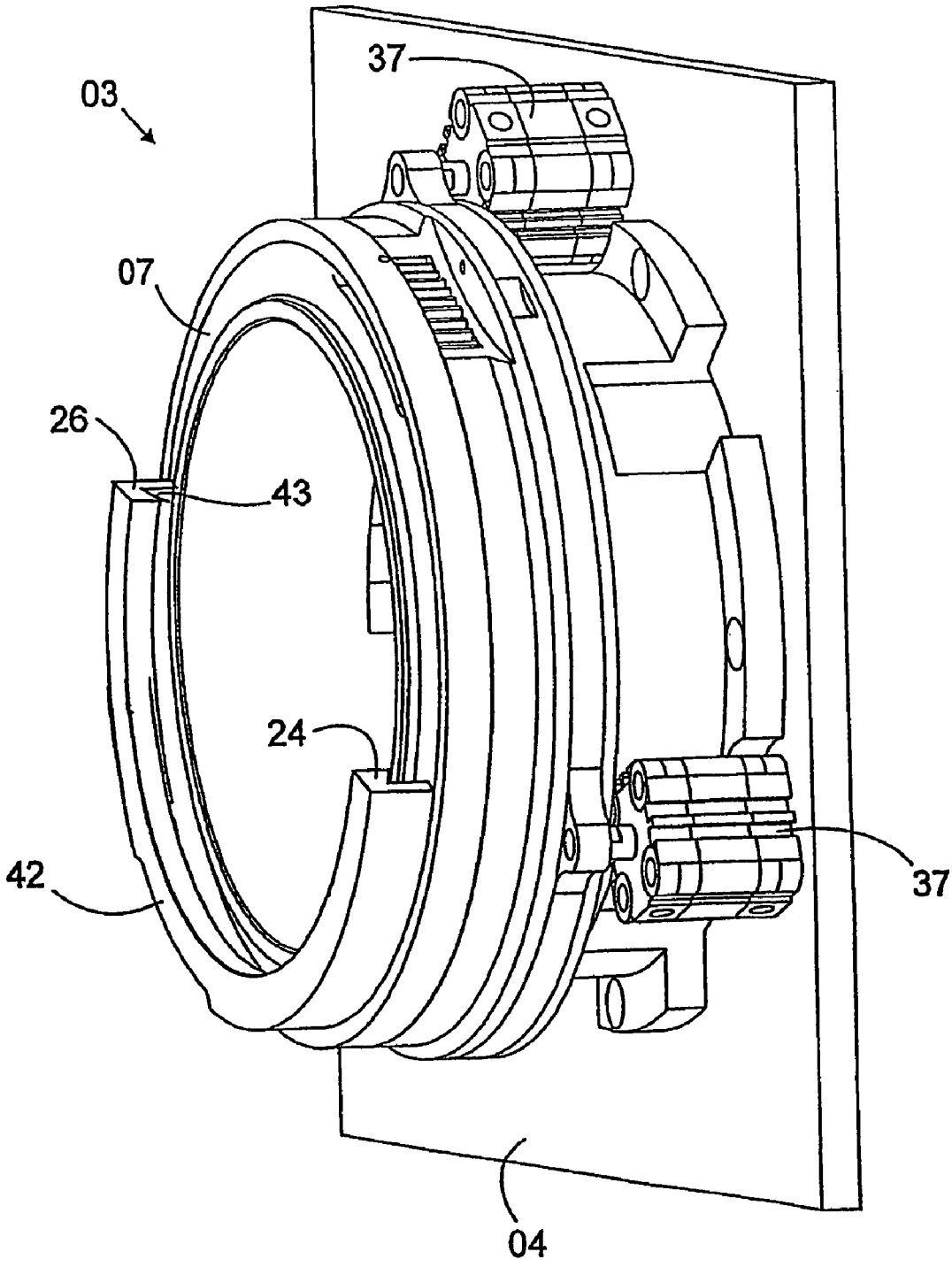

FIGS. 4 and 5 respectively show a perspective view of a bearing arrangement without and with a screen cylinder held therein;

FIG. 6 shows an axial section analogous to FIG. 2 through a second embodiment of a screen printing machine according to the invention;

FIG. 7 shows a view of a bearing arrangement according to the second embodiment.

Figure 1:
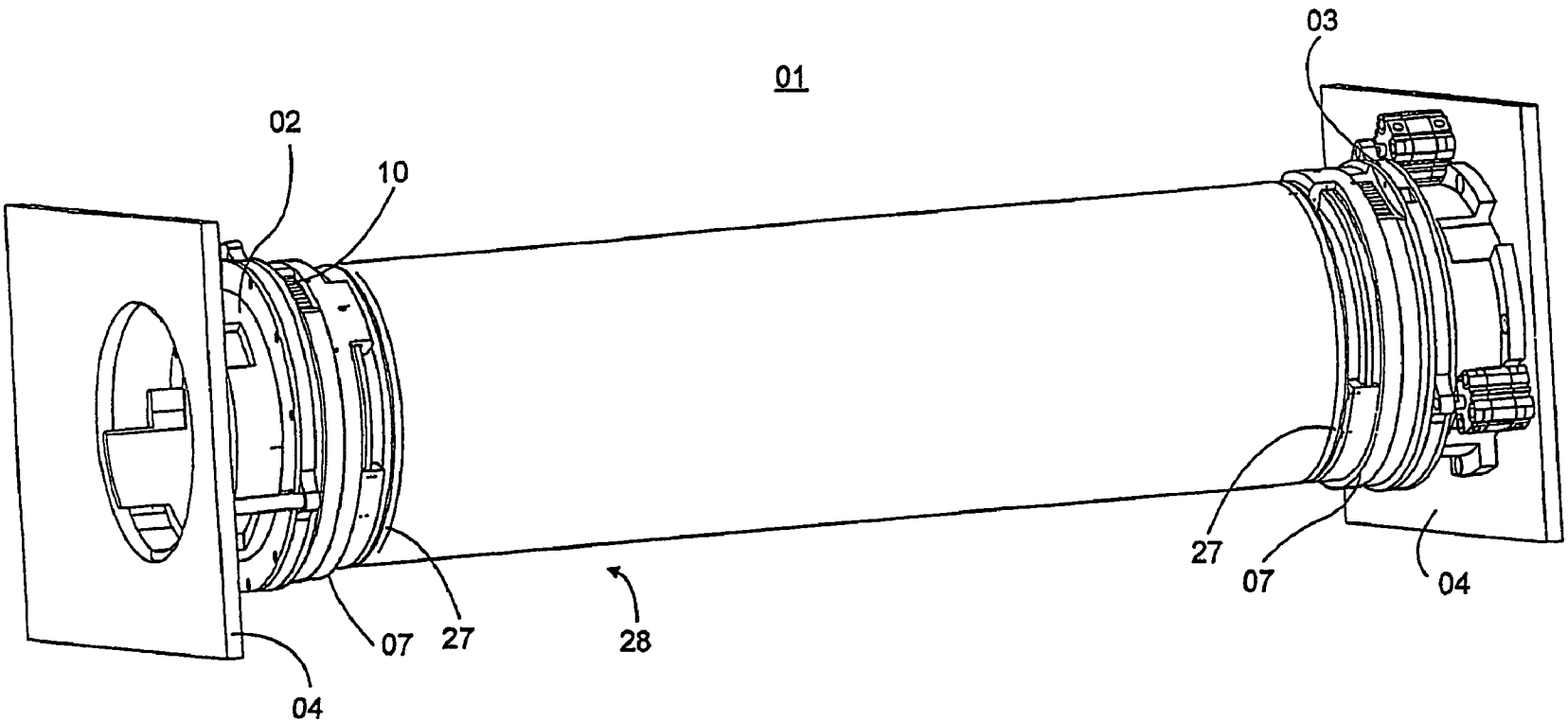
FIG. 1 shows a perspective view of a screen cylinder and. its bearing arrangements in a screen printing machine according to the invention.

FIG. 1 shows a perspective view of part of a screen printing machine according to the invention. There can be seen a screen cylinder 01, held by two bearing arrangements 02; 03, which are each mounted on frames 04 of the screen printing machine, said frames only being shown in part. A doctor blade which is likewise connected to the frames 04 and mounted fixedly within the screen cylinder 01 is not shown for the sake of clarity.

The design of the bearing arrangements 02; 03 and of the screen cylinder 01 is explained in particular with reference to FIG. 2. Each bearing arrangement 02; 03 comprises a hollow cylindrical shaft 06 which is fixedly connected to the respective frame 04 and on which a ring 07 is mounted to rotate via a bearing 08, e.g. a needle bearing 08. An outer gear rim 09 of each ring 07 is surrounded over a large part of its circumference by a sleeve which is fixedly connected to the adjacent frame 04. A window 10 of the sleeve, which is shown in FIG. 1, allows a toothed wheel 11 to mesh with the gear rim 09 of the bearing arrangements 02, 03. The toothed wheels 11 on both sides of the screen printing machine can be driven at the same speed by a drive motor via a gear mechanism (not shown).

The ring 07 is composed of two concentric part-rings 12; 13, an inner part-ring 12 which bears the gear rim 09 and a first claw 13 which will be explained in more detail below and an outer part-ring 14 which can rotate around the inner part-ring 12 and bears a second claw 16. In the section of FIG. 2 and the perspective view of FIG. 4, these two claws 13; 16 are shown diametrically opposite one other.

In this position, the outer part-ring 14 is fixed in rotation with respect to the inner part-ring 12 by a spring seat 17 which is embedded in the inner part-ring 12 and presses a ball 18 into a recess on the inner side of the outer part-ring 14 which faces the inner part-ring 12.

The two claws 13; 16 each have a strut section 19; 21 extending parallel to the axis of the screen cylinder 01 and a head section 22 or 23 extending from the free end of the strut section 19 or 21 radial to the axis of the screen cylinder 01.

As shown in the perspective view of FIG. 4, the strut section 19 of the first claw 13 extends in a semicircular manner over half the circumference of the ring 07. The head section 22 of the first claw 13 is shorter in comparison. On one side 24 of the first claw 13 which faces the viewer in FIG. 4, the strut section 19 and the head section 22 are flush, and on the opposite side 26 the head section 22 ends about 30° before the strut section 19.

The rotatable second claw 16 extends for its part over about 30° of the ring circumference. It can be rotated out of the position shown in FIG. 4 and into a position in which its head section 23 makes contact with the side 26 of the head section 22, so that both claws 13, 16 together extend over exactly half the circumference of the ring 07.

In this position of the claws 13; 16, it is possible to mount the screen cylinder 01.

As can be seen in FIG. 1, the screen cylinder 01 comprises two head pieces 27, which are each provided to be mounted on the bearing arrangements 02; 03, and also a screen 28 which is stretched in a cylindrical manner by the head pieces 27. As can be seen in FIG. 2, this head piece 27 is made in one piece of a cylindrical support section 29, the outer surface of which is provided for fixing the screen 28 thereto in a manner known per se, and a radially projecting flange 31, said two parts being connected to one another by a transition section 32 having a smaller external diameter than that of the support section 29 or flange 31.

Figure 3:
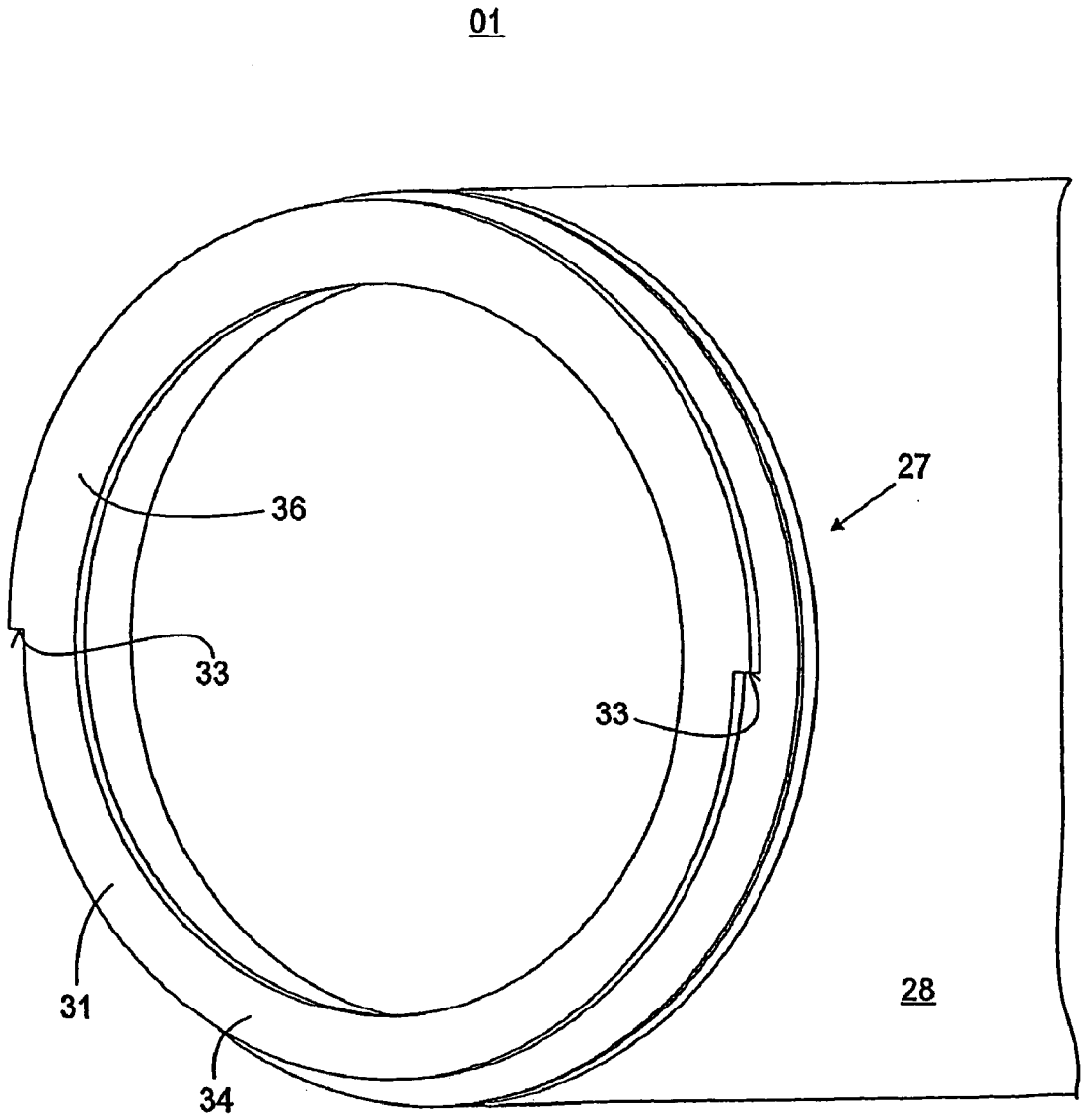
FIG. 3 shows a head region of a screen cylinder according to the invention.

FIG. 3 shows a perspective view of part of the screen cylinder 01 comprising a head piece 27. The flange 31 of the head piece 27 has two sections 34; 36 with different radii which are stepped with respect to one other in the circumferential direction by radially oriented surfaces 33. Each section 34; 36 in this case extends over half the circumference of the flange 31. The radius of the section 34 having a smaller radius corresponds to the inner radius of the strut section 19, and that of the section 36 having a greater radius corresponds to the outer radius of the strut section 19 or, and this is preferably the same apart from a slight clearance, to the inner radius of the strut section 21. When the second claw 16 is in its above-described position next to the first claw 13, the flange 31 thus shaped can be easily introduced into the bearing arrangement 02 or 03 in a movement transverse to the axis of the screen cylinder 01. As it is being introduced, the radially oriented surfaces 33 come into contact with the sides of the strut section 21. By rotating the outer part-ring 14, the claw 16 thereof reaches the position shown in FIGS. 4 and 5 in which it lies diametrically opposite the claw 13. The head piece 27 is thus fixed on the bearing arrangement 03, as shown in FIG. 5. The radially oriented surfaces 33 of the flange 31 are in each case in contact with the edges of the strut section 19 of the first claw 13, so that rotation of the ring 07 is transmitted in a precise manner to the screen cylinder 01.

In order to tighten the screen 28 of the screen cylinder 01 mounted in this way on the bearing arrangements 02, 03, the bearing arrangement 03 is equipped with three linear actuators 37 in the form of a working cylinder, e.g. a pneumatic or hydraulic cylinder, which linear actuators are able to push the ring 07 in the axial direction. These linear actuators 37 are actuated to push the ring 07 of the bearing arrangement 03 in the direction of the opposite bearing arrangement 02 and thus to release the tension of the screen 28 when the screen cylinder 01 has to be removed. Following installation of a screen cylinder 01, the linear actuators 37 pull the ring 07 in the opposite direction in order to tighten the screen 28.

As can be seen in FIG. 5, there is a small gap 38 between an inner side 39 of the head sections 22; 23 of the claws 13; 16, which inner side extends radially and faces the ring 07, and a surface of the flange 31 which faces this inner side. This gap 38 is kept open by spring elements 41, e.g. pressure springs 41, embedded in the head sections 22 and 23, as shown in FIGS. 2 and 4. These pressure springs 41 make it possible for a predefined tension to be set during tightening of the screen 28, and their flexibility helps to prevent a critical tension from being exceeded during operation, which could lead to the screen being damaged, and also compensates for axial run-out of the flange 31.

An alternative embodiment of the invention is shown with reference to FIGS. 6 and 7, which respectively show views analogous to FIGS. 2 and 4. Elements of this second embodiment which correspond to elements that have been described above bear the same references and are not described again. This second embodiment differs from the first in that ring 07 of each bearing arrangement 02; 03 is made in one piece and bears a single claw 42 which extends over an angle of 180° around the axis of the screen cylinder 01. An inner surface 43 of the claw 42 which faces the ring 07 is cone-shaped, with the vertex of the cone facing away from the respectively opposite bearing arrangement 02; 03. As a complement to the shape of the inner surface 43, the flange 31 likewise has a cone-shaped surface.

In this case, too, the flange 31 has two sections with different radii which are connected by radial surfaces which in the mounted state make contact with the sides 24; 26 of the claw 42, in order to ensure precise transmission of the rotary movement of the ring 07 to the screen cylinder 01.

When the linear actuators 37 are actuated in order to tension the screen 28 to prepare for operation of the screen printing machine, the inner surface 43 of the claw 42 comes into intimate contact with the flange 31. The cone shape of the inner surface 43 and of the surface of the flange 31 which faces it means that along the inner surface 43 a force oriented radially outwards acts on the flange 31, which prevents the flange 31 from escaping from the claw 42.

Spring elements 44, e.g. pressure springs 44, which are embedded in the claw 42 are provided to loosen the contact between the inner surface 43 and the flange 31 when the tension on the screen 28 is relieved to remove the screen cylinder 01, and thus to facilitate removal of the head piece from the bearing arrangement 02; 03.

In the embodiments described above, it has been assumed that each ring or part-ring bears only one claw 13; 16 or 42. However, it is obvious that the number of claws may in principle be selected at will, provided that all the claws fit within an angular range of 180° so that they do not obstruct the lateral introduction of a head piece into the bearing arrangements 02; 03.

LIST OF REFERENCES

01 screen cylinder
02 bearing arrangement
03 bearing arrangement
04 frame
05 -
06 shaft
07 ring
08 bearing, needle bearing
09 gear rim
10 window
11 toothed wheel
12 part-ring, inner
13 claw, first
14 part-ring, outer
15 -
16 claw, second
17 spring seat
18 ball
19 strut section
20 -
21 strut section
22 head section
23 head section
24 side (13)
25 -
26 side (13)
27 head piece
28 screen
29 support section
30 -
31 flange
32 transition section
33 surface, radially oriented
34 section (31)
35 -
36 section (31)
37 linear actuator
38 gap
39 inner side
40 -
41 spring element, pressure spring
42 claw
43 inner surface
44 spring element, pressure spring

The invention claimed is:

1. A screen printing machine comprising first and second bearing arrangements for holding a screen cylinder provided with first and second flanges at extremities thereof, wherein said first bearing arrangement comprises a first ring for receiving the first flange of the screen cylinder and said second bearing arrangement comprises a second ring for receiving the second flange of the screen cylinder, at least said first ring comprising at least one claw for holding the first flange of the screen cylinder, wherein the said at least one claw is provided with at least one spring element cooperating with the first flange of the screen cylinder, said at least one spring element exerting an axial force on said first flange, which axial force is oriented away from the second bearing arrangement.

2. The screen printing machine as claimed in claim 1, wherein the first ring comprises a single claw which cannot move, said single claw being located within an angular range of 180° about an axis of rotation of the screen cylinder.

3. The screen printing machine as claimed in claim 1, wherein, during operation of the screen printing machine, the said at least one spring element keeps open a gap between the first flange of the screen cylinder and an inner surface of said at least one claw.

4. The screen printing machine as claimed in claim 1, wherein, during operation of the screen printing machine, an inner surface of the said at least one claw contacts the first flange.

5. The screen printing machine as claimed in claim 1, wherein said first bearing arrangement further comprises at least one actuator for displacing the first ring in a direction parallel to an axis of rotation of the screen cylinder for tensioning the screen cylinder or releasing tension of the screen cylinder.

6. The screen printing machine as claimed in claim 1, wherein each one of said first and second flanges has first and second sections with different radial widths defining radially oriented surfaces between the first and second sections, said radially oriented surfaces being in contact with side surfaces of the said at least one claw of the first ring, respectively second ring.

7. The screen printing machine as claimed in claim 1, wherein said first and second rings are rotatable about an axis of rotation of the screen cylinder and drive the screen cylinder in rotation.

8. A screen printing machine comprising first and second bearing arrangements for holding a screen cylinder provided with first and second flanges at extremities thereof, wherein said first bearing arrangement comprises a first ring for receiving the first flange of the screen cylinder and said second bearing arrangement comprises a second ring for receiving the second flange of the screen cylinder, each one of said first and second rings having at least one claw with a cone-shaped inner surface centered on an axis of rotation of the screen cylinder, which cone-shaped inner surface cooperates with a likewise cone-shaped surface of the first flange, respectively second flange, of the screen cylinder.

9. The screen printing machine as claimed in claim 8, wherein said first bearing arrangement further comprises at least one actuator for displacing the first ring in a direction parallel to the axis of rotation of the screen cylinder for tensioning the screen cylinder or releasing tension of the screen cylinder.

10. The screen printing machine as claimed in claim 8, wherein the first ring comprises a single claw which cannot move, said single claw being located within an angular range of 180° about the axis of rotation of the screen cylinder.

11. The screen printing machine as claimed in claim 8, wherein at least the said at least one claw of the first bearing arrangement has spring elements for exerting an axial force oriented away from the second bearing arrangement, which spring elements cooperate with the first flange of the screen cylinder.

12. The screen printing machine as claimed in claim 8, wherein, during operation of the screen printing machine, an inner surface of the said at least one claw contacts the first flange.

13. The screen printing machine as claimed in claim 8, wherein each one of said first and second flanges has first and second sections with different radial widths defining radially oriented surfaces between the first and second sections, said radially oriented surfaces being in contact with side surfaces of the said at least one claw of the first ring, respectively second ring.

14. The screen printing machine as claimed in claim 8, wherein said first and second rings are rotatable about the axis of rotation of the screen cylinder and drive the screen cylinder in rotation.

15. The screen printing machine as claimed in claim 1, wherein the first ring comprises a number of claws which cannot move relative to one another, said number of claws being located within an angular range of 180° about an axis of rotation of the screen cylinder.

16. The screen printing machine as claimed in claim 8, wherein the first ring comprises a number of claws which cannot move relative to one another, said number of claws being located within an angular range of 180° about the axis of rotation of the screen cylinder.

17. A screen printing machine comprising first and second bearing arrangements for holding a screen cylinder provided with first and second flanges at extremities thereof, wherein said first bearing arrangement comprises a first ring for receiving the first flange of the screen cylinder and said second bearing arrangement comprises a second ring for receiving the second flange of the screen cylinder, at least said first ring comprising at least one claw for holding the first flange of the screen cylinder, wherein the said at least one claw is provided with at least one spring element cooperating with the first flange of the screen cylinder, said at least one spring element exerting an axial force on said first flange, which axial force is oriented away from the second bearing arrangement, and wherein each one of said first and second flanges has first and second sections with different radial widths defining radially oriented surfaces between the first and second sections, said radially oriented surfaces being in contact with side surfaces of the said at least one claw of the first ring, respectively second ring.

18. A screen printing machine comprising first and second bearing arrangements for holding a screen cylinder provided with first and second flanges at extremities thereof, wherein said first bearing arrangement comprises a first ring on an inner side of which the first flange of the screen cylinder is located and said second bearing arrangement comprises a second ring on an inner side of which the second flange of the screen cylinder is located, each one of said first and second rings having at least one claw with a cone-shaped inner surface centered on an axis of rotation of the screen cylinder, which cone-shaped inner surface cooperates with a likewise cone-shaped surface of the first flange, respectively second flange, of the screen cylinder.

* * * * *